United States Patent [19]

Berz

[11] 4,250,729

[45] Feb. 17, 1981

[54] SYSTEM FOR SELECTIVELY TRANSFERRING FLEXIBLE AND RELATIVELY BENDING-RESISTANT SHAPED SECTIONS OF DIFFERENT CROSS-SECTIONAL FORM BETWEEN CONTINUOUS SMALL STRUCTURAL AND MERCHANT MILLS AND COOLING BEDS DISPOSED DOWNSTREAM THEREOF

[75] Inventor: Gerhard Berz, Dusseldorf, Fed. Rep. of Germany

[73] Assignee: Schloemann-Siemag Aktiengesellschaft, Dusseldorf, Fed. Rep. of Germany

[21] Appl. No.: 56,518

[22] Filed: Jul. 11, 1979

[30] Foreign Application Priority Data

Jul. 13, 1978 [DE] Fed. Rep. of Germany ..... 2830806

[51] Int. Cl.[3] ..... B21B 43/00; B21B 39/161

[52] U.S. Cl. ..... 72/251; 193/36

[58] Field of Search ..... 193/36; 72/250, 251

[56] References Cited

U.S. PATENT DOCUMENTS

| | | | |
|---|---|---|---|
| 2,878,918 | 3/1959 | Peterson | 193/36 X |
| 3,349,591 | 10/1967 | Thomas | 72/251 X |

FOREIGN PATENT DOCUMENTS

| | | | |
|---|---|---|---|
| 1200238 | 9/1968 | Fed. Rep. of Germany | 72/251 |

*Primary Examiner*—Milton S. Mehr

*Attorney, Agent, or Firm*—Holman & Stern

[57] ABSTRACT

Rolled stock from two parallel rolling mills is transferred to two adjacent cooling beds by apparatus which permits the stock from both mills to be fed to one bed or the stock from each mill to be fed to a respective one of the beds. The apparatus has a relatively short pivotable track portion upstream of a deviator portion. The deviator portion has one stock entrance and two stock exits, and the position of the pivotable track portion decides by which exit the stock leaves. A pivotable roller table downstream of the deviator portion can be positioned so as to receive the stock leaving the deviator portion and to guide the stock to the appropriate cooling bed.

9 Claims, 10 Drawing Figures

SYSTEM FOR SELECTIVELY TRANSFERRING FLEXIBLE AND RELATIVELY BENDING-RESISTANT SHAPED SECTIONS OF DIFFERENT CROSS-SECTIONAL FORM BETWEEN CONTINUOUS SMALL STRUCTURAL AND MERCHANT MILLS AND COOLING BEDS DISPOSED DOWNSTREAM THEREOF

FIELD OF THE INVENTION

The invention relates to a system for selectively transferring flexible and relatively bending-resistant shaped sections of various cross-sectional form in continuous small structural and merchant mills, in which each of two approximately parallel rolling lines are associated with a cooling bed, and where a pivotable deviator portion is disposed between the rolling lines which enables either one cooling bed to be fed simultaneously from both rolling lines or for a cooling bed associated with one or the other rolling line to be fed from each rolling line.

BACKGROUND OF THE INVENTION

German Pat. No. 12 49 801 discloses a very long double roller table for two parallel rolling lines. The roller table is constructed as a pivoting deviator and is disposed between the rolling mills and the cooling bed associated with each rolling line in a small structural and merchant mill with a wide rolling campaign as regards sectional shape and cross-sectional dimensions (German Pat. No. 10 57 048). It is therefore possible in continuous rolling operation in both lines, i.e. in two-strand rolling of thin sections, to supply cut lengths to each cooling bed or in the case of single-strand rolling of thick and relatively bending-resistant sections in one rolling line, the main or subsidiary strand, to alternately supply cut lengths to one or the other cooling bed. In view of the large pivoting deviator mass which has to be moved it is however possible for the pivoting deviator to be set from one cooling bed to that associated with the other rolling line in single-strand rolling at substantial intervals if the capacity of both cooling beds is to be utilized. In practice, one cooling bed is first fully loaded and thereafter the second cooling bed is fully loaded. The pivoting deviator thus offers the advantage of transferring relatively bending-resistant rolled stock to the cooling bed associated with the other rolling line under conditions of very slight deflection. This method of supplying both cooling beds suffers from the disadvantage of an average shorter cooling time of the cut lengths on the cooling beds. Moreover, the cold shears disposed downstream of the cooling beds are loaded with twice the production output when they are fed with the cut lengths associated with the cooling beds for the purpose of cutting into commercial lengths.

On the other hand, in a system comprising a pivotable cross-deviator disposed in the diagonal between the two rolling mills and the associated cooling beds and short pivoting deviators at the beginning and end of the intersecting roller table portions which enclose the cross-deviator between them, it is not possible for relatively bending-resistant rolled stock, more particularly broad flat sections of up to approximately 150 mm or large cross-sections or cross-sections with a high approach speed to be transferred smoothly, i.e. without plastic deformation of the longitudinal axis or without trouble to the second cooling bed with the least possible deflection.

OBJECT OF THE INVENTION

It is an object of the invention to provide a deflector system between a rolling mill, with two approximately parallel finishing trains or in multi-line configuration, and the associated cooling beds which will permit rapid, brief and precise resetting of the deflector, for example in the sequence time between two successive strands of rolled stock which are rolled from two successive initial-pass billets supplied to the rolling mill from the furnace, or will permit the resetting between two successive cut lengths while at the same time the advantage of only slight lateral deflection, more particularly in the case of relatively bending-resistant rolled stock is retained or improved.

SUMMARY OF THE INVENTION

The problem is solved in that the deviator portion of each rolling line comprises a stationary guiding roller table, a relatively short pivoting deviator with a stationary distributor roller table and the approach roller table to the cooling bed is formed by a pivoting roller table disposed downstream. The advantage of this construction of the deviator portion is that the very slight pivoting angle of the low-mass pivoting deviator enables the part lengths of relatively bending-resistant rolled stock in each strand to be reliably transferred from the rolling line, alternately to one or the other cooling bed, either during the sequence times of two successive strands of rolled stock of two initial-pass billets, fed successively to the rolling mill, or between two successive part lengths in single-strand rolling in one or the other rolling line of the two rolling lines which are approximately parallel with each other. There is sufficient time for positioning the long pivoting roller tables which adjoin the cooling bed and which are provided with separating and braking means, for example separating strips and braking rails for braking the cut lengths upstream of the cooling bed and for the transfer thereof. The transfer operation is required only, after conversion of the other rolling mill, for a single-strand rolling in the said rolling line, or alternatively to both cooling beds or in the case of a program change simultaneously in both rolling lines, which are approximately parallel with each other, i.e. in two-strand configuration, on to each of the cooling beds associated with the rolling line.

It is also advantageous if the stationary distributor roller table comprises two roller table portions in V configuration extending at a slight angle $\alpha$ of up to approximately 9° in which one longitudinal axis is oriented along the rolling line of the cooling bed associated with the said rolling line and the longitudinal axis of the second roller table portion is oriented towards the cooling bed associated with the other rolling line. The distributor roller table can be constructed, for example, in the form of a V-shaped roller table which is bifurcated.

In another embodiment of the invention the stationary guiding roller table, disposed downstream of the shear associated with each finishing group, is relatively long, for example 35 m long, followed by a short pivoting deviator of approximately 6 m length with a stationary distributor roller table of approximately 6 m adjoined in each rolling line by the cooling bed approach roller table which is constructed as a pivoting roller table.

In another embodiment of the invention the stationary guiding roller table disposed in each rolling line downstream of the shear associated with each finishing group, is relatively short, for example approximately 4 m long, followed by a short pivoting deviator of approximately 6 m length with a stationary distributor roller table of approximately 6 m and a longer roller table portion, which is slidable transversely to the rolling line and adjoining in each of these the cooling bed approach roller table which is constructed as a pivoting roller table. The advantage of this embodiment is that the angles between the bifurcated roller table portions of the distributor roller tables can be reduced still further by the long roller table part which is movable transversely to the rolling line.

In another embodiment of the invention the pivoting deviator as well as the movable roller table portions are movable in known manner along guide tracks with sliding means, for example pneumatic or hydraulic adjusting means or electric drives. In dependence on the cutting signal of the part shears disposed upstream, the pivoting deviator is controlled by a photocell or light electronic sensor disposed in the feeder roller table upstream of the pivoting deviator.

BRIEF DESCRIPTION OF THE DRAWINGS

Further objects and advantages of the invention will become apparent from the following description which is to be read in conjunction with the accompanying drawings. In the drawings

DETAILED DESCRIPTION OF THE PREFERRED EMBODIMENTS

Figure 1:
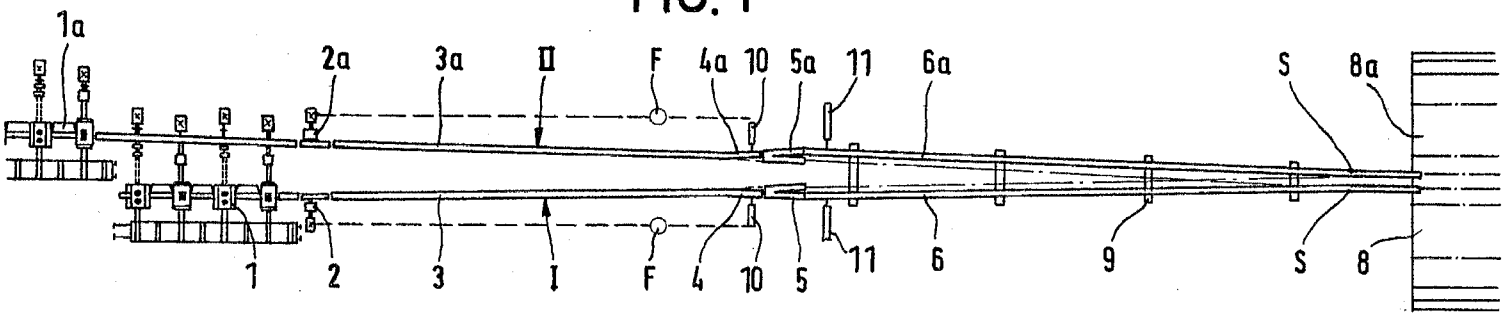
FIG. 1 shows the deviator system of one exemplified embodiment for two-strand rolling.

The numerals 1 and 1*a* in FIGS. 1 and 2 refer to the finishing groups of two approximately parallel rolling lines I and II, referred to hereinafter as the main strand I and auxiliary strand II.

The finishing groups 1, 1*a* are part of a small structural and merchant mill with roll stand groups arranged parallel with each other but in offset configuration and comprising two-high roll stands with grooved roll sets each of which is arranged one behind the other with an offset of 90° relative to each other. The construction of the rolling mill is known for example as a so-called multiline arrangement or as a rolling mill with two approximately parallel rolling lines and permits rolling of a wide rolling campaign either in both rolling lines simultaneously or in only one rolling line, of the most diverse shaped sections and cross-sectional dimensions of flexible and relatively bending-resistant rolled stock. The shaped sections substantially comprise round sections of 8 to 70 mm diameter, square sections of 8 to 70 mm edge length, hexagon and octagon sections of 8 to 70 mm across flats, flat sections of 12 to 150 mm width, equal flanged angles of 16×16 mm to 90×90 mm edge length as well as unequal flange angles of 30×20 to 100×75 mm edge length, channel sections of 30×20 to 100×400 mm, T-sections of 20 to 80 mm height as well as double T-sections of up to 100 mm width.

Two-strand rolling, performed simultaneously in rolling line I and II is possible for thin, flexible shaped sections and one-strand rolling in the rolling line I or rolling line II, i.e. in the main strand I or in the auxiliary strand II, is possible for thicker and relatively bending-resistant shaped sections.

Each of the finishing groups 1, 1*a* is followed by rotating dividing shears 2, 2*a* in roller tables not designated. Downstream of each of the dividing shears 2, 2*a* there is disposed a relatively long stationary guiding roller table 3, 3*a*, for example of 35 m length, each of which extends to a pivoting deviator 4, 4*a* of approximately 6 m length which can be actuated by hydraulic pneumatic or electric power means 10. The pivoting deviators 4, 4*a* of a length of approximately 6 m are also constructed as roller tables. Each of these is followed by a stationary distributor roller table 5, 5*a*, for example in V-shaped configuration, with roller table branches which bifurcate at an angle $\alpha$ of approximately 9°. One roller table portion of the distributor roller table 5 or 5*a* has its longitudinal axis disposed in the continuation of the rolling line I or II while the other roller table portion of the distributor roller table 5 or 5*a* has its longitudinal axis oriented diagonally at an angle $\alpha$ of up to approximately 9° towards the cooling bed 8*a*, 8, associated with the other rolling line II or I. Between each of the cooling beds 8 or 8*a* and each of the stationary distributor roller tables 5 or 5*a* there is disposed a pivoting roller table 6, 6*a* which can be pivoted from one rolling line into the other rolling line by hydraulic or like sliding means 11 along guideways 9 about a pivoting axis S which is disposed in front of the cooling bed. The pivoting roller table 6 or 6*a* also forms the approach roller table to the appropriate cooling beds and continues adjacent to the cooling beds and is provided with approach channels, separating and braking means such as braking slides for braking the infed cut lengths and for transferring the same to the cooling bed. The pivoting roller table 6 or 6*a* is adjusted only once in the event of a program change.

In the arrangement illustrated in FIG. 1 and given a rolling speed of, for example, 20 m/s, it is possible for thin, flexible shaped sections of the above-mentioned cross-sectional dimensions to be supplied simultaneously in both rolling lines I and II to the associated cooling beds 8 or 8*a*. Moving the pivoting deviator 4, 4*a* or any other parts of the roller table is not necessary in this case while a particular campaign is being rolled.

Figure 2:
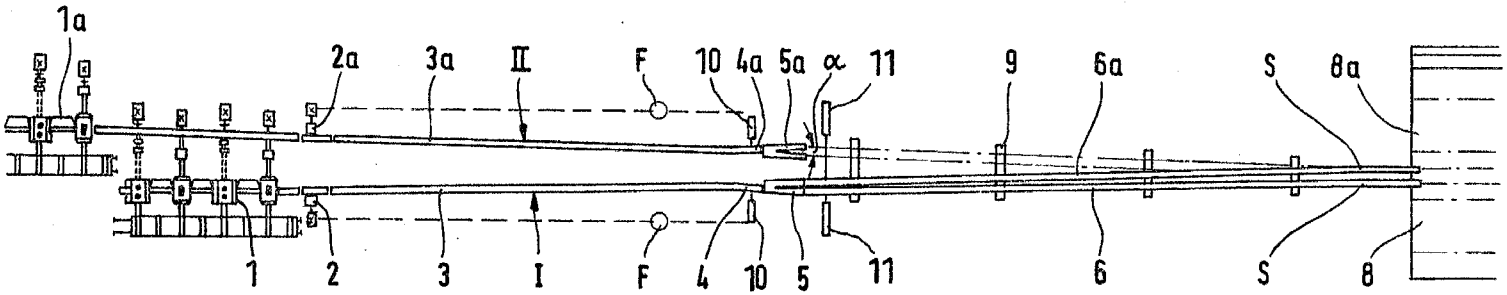
FIG. 2 shows the deviator system according to FIG. 1 for one-strand rolling.

Another exemplified embodiment of the system is shown in FIG. 2. This arrangement differs from that shown in FIG. 1 only by virtue of the pivoting roller table 6*a* having been pivoted by the sliding means 11 from the rolling line I into the roller table portion which is associated with the distributor roller table 5 and whose longitudinal axis os oriented towards the cooling bed 8*a*. Given one-strand rolling it is possible with this method of operation in the rolling line I to supply relatively bending-resistant sectional shapes of larger cross-sectional dimensions, such as thicker light gauge and merchant sections, with the least possible lateral deflection of up to approximately 90°, alternatively to the cooling bed 8 or to the cooling bed 8*a* when the pivoting deviator 4 is reversed. With this arrangement it is also possible for flat sections of up to 150 mm width to be deflected without sustaining any permanent curvature. The pivoting deviator 4 can be reversed without difficulty during the short interval which occurs after each strand rolled from an initial-pass billet, namely between the exiting tail end of the leading rolled strand and the incoming tip end of the succeeding rolled strand associated with the next initial-pass billet or in the subsequent time between two successive partial lengths. This partial lengths of an initial-pass billet supplied to the rolling mill or the successive partial lengths can be alternately transferred to each of the cooling beds 8 or 8*a*. The dwell time and therefore the cooling time of the cut lengths on the cooling bed can therefore be increased but on the other hand it is also possible for different material qualities of the initial pass billet supplied by the rolling mill to be separated.

The exemplified embodiment of FIG. 2 can also be applied to the rolling line II for one-strand rolling of thicker and relatively bending-resistant small structural and merchant sections, when the pivoting roller table 6*a* supplies the cut lengths to the cooling bed 8*a* and the pivoting roller table 6, pivoted into the other roller table portion of the distributor roller table 5*a*, supplies the cut lengths to the cooling bed 8. In this case the pivoting deviator 4*a* is operated alternately as already described. The pivoting roller table 6, 6*a* is displaced only once for a program change.

Figure 3:
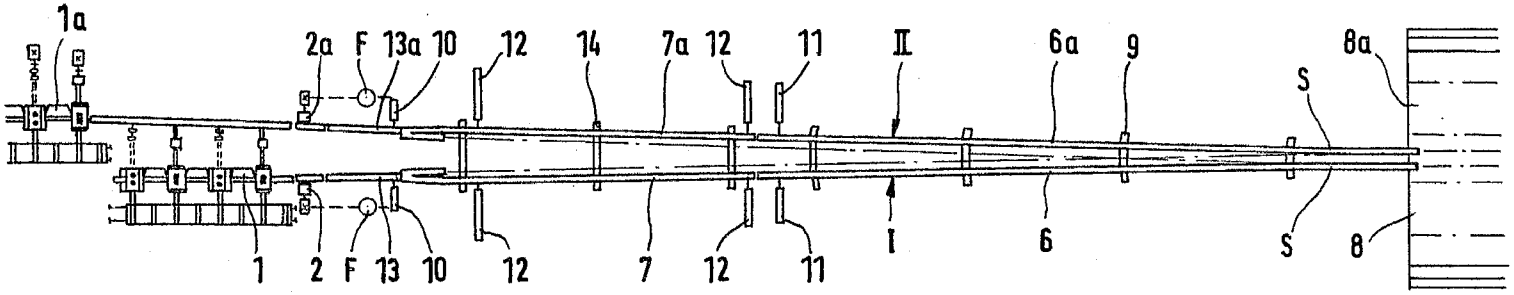
FIG. 3 shows the deviator system of a further exemplified embodiment for two-strand rolling.
Figure 4:
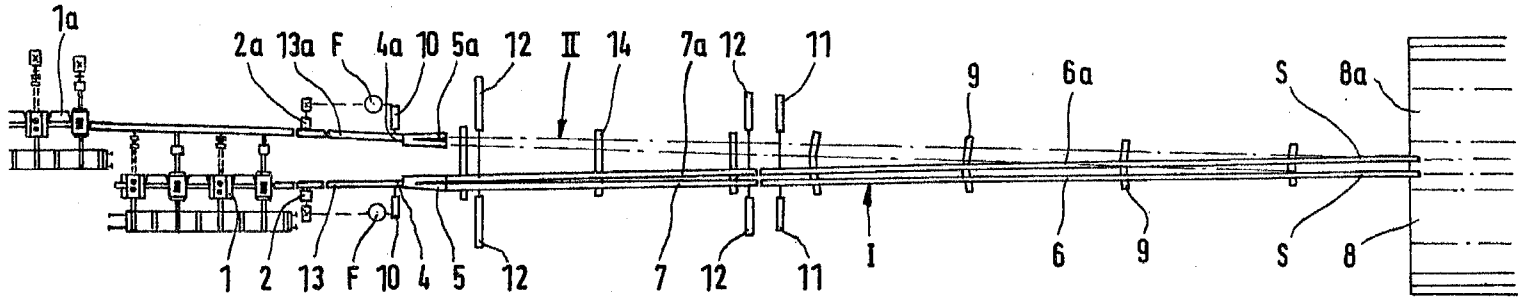
FIG. 4 shows the deviator system according to FIG. 3 for one-strand rolling.

FIGS. 3 and 4 shows an alternative arrangement according to FIGS. 1 and 2. The numerals 1 and 1*a* again refer to finishing groups disposed in rolling lines I and II which are approximately parallel with each other. The finishing groups 1, 1*a* are also part of a rolling mill for small structural and merchant sections for the production of flexible and relatively bending-resistant shaped sections of various cross-sectional shape having predefined dimensions. Disposed downstream of the finishing groups 1, 1*a* are roller tables, not designated, as well as rotating dividing shears 2, 2*a* which are followed by relatively short stationary guiding roller tables 13, 13*a* of approximately 4 m in length with pivoting deviators 4, 4*a* and stationary distributor roller tables 5, 5*a*, for example of V configuration, each being of approximately 6 m length. The stationary distributor roller tables 5*a* is constructed in V configuration in such a way that the longitudinal axis of one bifurcated roller table portion is orientated along the rolling line I and the longitudinal axis of the other bifurcated roller table portion is oriented diagonally in a direction towards the cooling bed 8*a* which is associated with the second rolling line II. The roller table 5 is similarly constructed.

Between each of the pivoting roller tables 6, 6*a*, which precede the cooling beds 8, 8*a*, and the stationary distributor roller tables 5, 5*a* there is disposed a longer roller table portion 7, 7*a* which can be traversed in a horizontal plane along guideways 14 by sliding means 12. The roller table portions 7, 7*a* are adapted to permit the transfer of part lengths of thicker sectional shapes, for example from the rolling line I via the pivoting roller table 6*a* to the cooling bed 8*a* of the rolling line II or vice versa with only a slight lateral deflection. The insertion of the roller table portions 7, 7*a* enables the distance between the two rolling lines I and II to approach each other still further during one-strand rolling, using one of the finishing groups 1 or 1*a* (see FIG. 4), and the deflecting angle $\alpha$ for transferring the rolled stock by means of the distributor roller tables 5, 5*a* can be reduced still further.

The arrangement for two-strand rolling of thinner, flexible sectional shapes at high rolling speeds, for example approximately 20 m/s, and having different cross-sectional shapes, in the rolling line I or the main strand I and the rolling line II or the auxiliary strand II, each feeding a cooling bed 8, 8*a*, is shown in FIG. 3.

FIG. 4 shows the arrangement for one-strand rolling of thicker, relatively bending-resistant shaped sections of different cross-sectional shape or at high rolling speeds, such as small structural and merchant sections where cut lengths of a strand of rolled stock are alternately transferred from the main strand I to the cooling bed 8 or to the cooling bed 8*a*. The method of operation corresponds to that described by reference to FIG. 2 in which continuous guiding of the rolled stock to the cooling bed 8 and continued guiding of the rolled stock from the second roller table portion of the distributor roller table 5 via transversable roller table portion 7*a* and the pivoting roller table 6*a* to the cooling bed 8*a* is established from the rolling line I via the transversable roller table part 7 and the pivoting roller table 6. As in FIG. 2, it is then also possible, by operation of the short pivoting deviator 4 to separate the cut lengths of the strand rolled from the next initial pass billet or from the successive cut lengths after a strand of stock rolled from an initial pass billet has passed through and has been divided into cut lengths. The cut lengths rolled from each initial pass billet or the successive cut lengths can thus be alternately guided to the cooling bed 8 or the cooling bed 8*a* so that a longer dwell time is achieved for cooling of the cut lengths on the cooling bed, since after delivery of the last cut lengths of a billet the affected cooling bed does not perform a cross-feed motion until the cut lengths of the next but one billet or the next but one cut length is again supplied to the said cooling bed. Also, the qualities of rolled products obtained from differential initial pass billets, supplied to the rolling mill by the furnace, can be advantageously separated from each other.

In this case the traversing part of the roller tables 7, 7*a* and the pivoting roller table 6, 6*a* are displaced only in the event of a program change.

The arrangement shown in FIG. 4 for the rolling line I can also be applied to the rolling line II as shown in broken lines, namely for thicker cross-sections of relatively bending-resistant rolled stock and for high rolling speeds.

An advantage of the arrangement according to FIGS. 2 and 4 is due to the fact that large sectional shapes which are particularly sensitive to deflection, more particularly broad flat sections of up to 150 mm width, can be transferred without problems in one-strand rolling, alternately to one or to the other cooling bed in the interval times between successive cut lengths or of successive strands of stock rolled from initial pass billets. In addition there is sufficient manipulating time available to set the pivotable roller part portions from two-strand rolling to one-strand rolling as means for guiding the rolled stock to the cooling beds. This arrangement is also suitable for alternately transferring cut lengths of sectional shapes at high rolling speeds to both cooling beds.

It should also be noted that the pivoting deviators 4, 4*a* are also constructed as short roller table portions or as guides for rolled stock and changing from one rolling line to the other is performed in the interval times between the tail end of one rolled stock strand of the preceding first pass billet and the tip end of the subsequent rolled stock strand of the next initial pass billet or during the interval time between two successive cut lengths, namely by means of electric sensors F, for example photocells, and pneumatic, hydraulic or electric shifting means 10. The electric sensors F are controlled in dependence on the cutting signal of the dividing shears 2, 2*a*. Braking and separating means disposed in the approach roller tables 6, 6*a* are connected via articulated links to those of additional approach roller tables adjacent to the cooling beds.

The longitudinal axes, as shown in FIGS. 1 to 4 in broken lines, in conjunction with the pivoting roller tables 6, 6*a* transfer the cut lengths on to the cooling beds 8, 8*a* in one-strand operation along the rolling line I or II in accordance with the control affected by the pivoting deviator 4, 4*a*.

Figure 5:
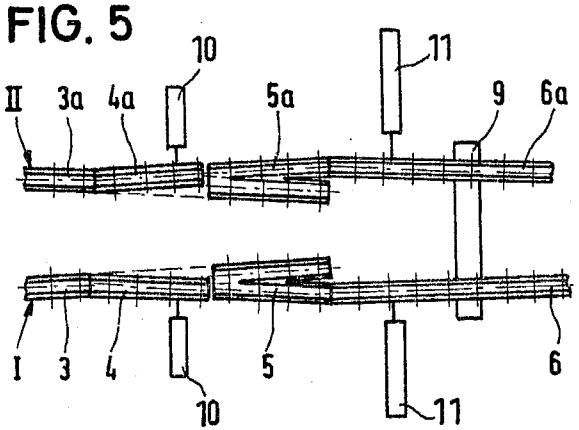
FIG. 5 shows the pivoting deviator and the distributor disposed downstream thereof in an enlarged view.

FIG. 5 is an enlarged section of the pivoting deviator with the distributor roller table.

In a small section and merchant mill of the above-described arrangement with a maximum rolling speed of approximately 20 m/s for rolling sectional shapes and ribbed steel or lead bearing steel the distance between the pivoting roller table 6, 6*a* and the beginning of the cooling beds 8, 8*a* is approximately 85 m, the distance between the rotating guiding shears 2, 2*a* to the beginning of the pivoting roller tables 6, 6*a* is approximately 35 m and the distance between the rotating dividing shears 2, 2*a* and the beginning of the cooling beds 8, 8*a* is approximately 120 m.

Figure 6:
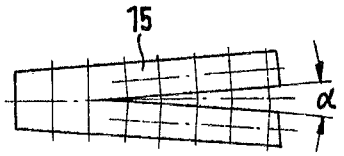
FIGS. 6, 6*a*, 6*b* and 7, 7*a* show further exemplified embodiments of the distributor roller table.

As will be described subsequently the distributor roller table can be constructed in different ways. According to FIG. 6 the distributor roller table 15 is divided into two roller table portions in V-configuration, bufurcated at an angle $\alpha$.

The roller table rollers, shown in the drawing only in principle by the extension of their longitudinal axes can be constructed as extending at right angles to the longitudinal axis (shown in chain-dotted lines) of the roller table portion or they can be constructed as skew rollers.

Figure 6A:
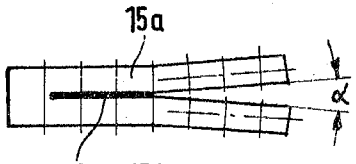

According to FIG. 6*a* the distributor roller table 15*a* has a broader roller table provided on the inlet side with a separating strip 16 down the middle. The strip 16 stops at the point where the roller table portions divide at an angle $\alpha$. The roller table rollers are disposed at right angles to the longitudinal axes of the divided portions.

Figure 6B:
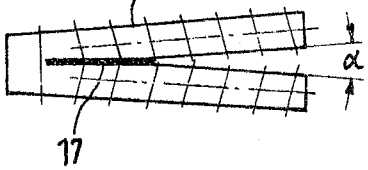

FIG. 6*b* also shows the distributor roller table 15*b* on the inlet side as a broader roller table constructed with a separating strip 17 in which the roller table rollers in the roller table branches are provided with skew rollers, i.e. roller table rollers which are inclined at an angle to the longitudinal axis of the roller table branches.

Figure 7A:
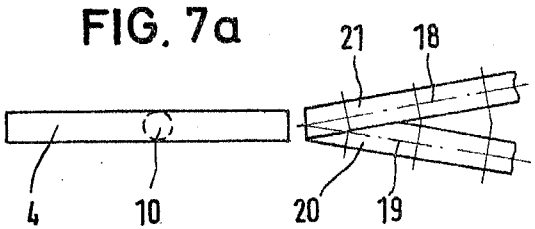
Figure 7:
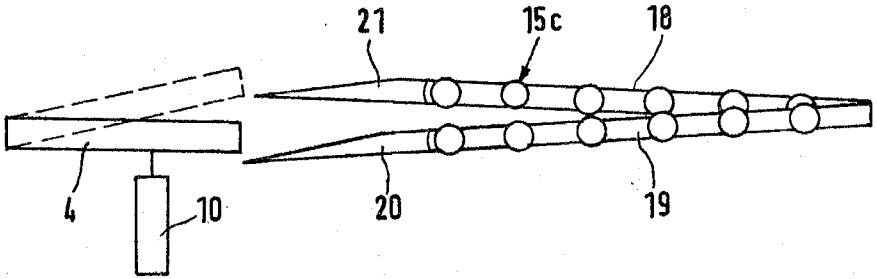

FIGS. 7, 7*a* show another distributor roller table 15*c* as a side view and plan view in which the pivoting deviator 4 can be reversed along the vertical plane by power means 10. In this embodiment the roller table branches 18, 19 are disposed one above the other and diverge in a spatial inclination along a horizontal plane at an angle. On the inlet side the roller table branches are provided with plate covers 20, 21 which converge in wedge configuration to ensure reliable guiding of the cut lengths which move on to said covers after control by the pivoting deviator 4, 4*a*.

All roller table rollers of the fixed and movable roller table portions are advantageously provided in known manner with individual drives. Depending on operational requirements the roller table rollers of the roller table branches can be constructed as roller tables disposed at right angles to the longitudinal axes or they can be constructed as skew rollers. The roller table branches can also be replaced where appropriate by simple trough members.

I claim:

1. Apparatus for selectively transferring flexible and relatively bending-resistant shaped sections of various cross-sectional forms from two continuous small structural/merchant rolling mills having adjacent and approximately parallel rolling lines to cooling beds disposed downstream of the mills, the apparatus comprising stationary guiding roller tables downstream of the mills, pivotable deviator portions immediately downstream of the guiding roller tables, the deviator portions being short relative to the guiding roller tables, stationary distributor roller tables immediately downstream of the deviator portions, and pivotable roller tables downstream of the distributor roller tables and upstream of the cooling beds, whereby either one of the cooling beds can be fed simultaneously from both rolling lines, or each rolling line can feed a respective cooling bed.

2. The apparatus of claim 1, wherein the stationary distributor roller tables each comprise two roller table portions in V configuration extending at a slight angles to one another, the longitudinal axis of one table portion being oriented along the respective rolling line and the longitudinal axis of the other roller table portion being oriented towards the cooling bed associated with the other rolling line.

3. The apparatus of claim 1, wherein the stationary guiding roller tables are of relatively long dimensions.

4. The apparatus of claim 1, wherein the stationary guiding roller tables are of relatively short dimensions.

5. The apparatus of claim 3, wherein the pivotable deviator portions and the distributor roller tables are disposed downstream of the relatively long stationary guiding roller tables.

6. The apparatus of claim 4, wherein the pivotable deviator portions and the distributor roller tables are disposed downstream of the relatively short stationary guiding roller tables, and roller table parts, which are movable transversely to the rolling line, are disposed between the distributor roller tables and the pivotable roller tables.

7. The apparatus of claim 1, and wherein the pivotable deviator portions and roller tables are movable by sliding means along guide tracks.

8. The apparatus of claim 6, and wherein the movable roller table parts are movable by sliding means along guide tracks.

9. The apparatus of claim 1, wherein shears for cutting the sections are provided upstream of the pivotable deviator portions, and electronic sensors, activated by the shears, pass signals to the pivotable deviator portions to control the movement of said portions laterally with respect to the rolling line.

* * * * *